US007353916B2

(12) United States Patent
Angst

(10) Patent No.: US 7,353,916 B2
(45) Date of Patent: Apr. 8, 2008

(54) ELEVATOR SUPERVISION

(75) Inventor: Philipp Angst, Zug (CH)

(73) Assignee: Inventio AG, Hergiswil (CH)

( * ) Notice: Subject to any disclaimer, the term of this patent is extended or adjusted under 35 U.S.C. 154(b) by 546 days.

(21) Appl. No.: 11/133,729

(22) Filed: May 20, 2005

(65) Prior Publication Data

US 2005/0269163 A1 Dec. 8, 2005

(30) Foreign Application Priority Data

Jun. 2, 2004 (EP) ..... 04405334

(51) Int. Cl.
*B66B 1/34* (2006.01)

(52) U.S. Cl. ..... 187/393; 187/314

(58) Field of Classification Search ..... 187/247, 187/248, 313, 314, 391–394
See application file for complete search history.

(56) References Cited

U.S. PATENT DOCUMENTS

| | | | | |
|---|---|---|---|---|
| 4,627,518 | A * | 12/1986 | Meguerdichian et al. | 187/394 |
| 5,107,964 | A * | 4/1992 | Coste et al. | 187/280 |
| 5,274,203 | A * | 12/1993 | Skalski et al. | 187/393 |
| 5,321,216 | A | 6/1994 | Jamieson et al. | |
| 5,407,028 | A * | 4/1995 | Jamieson et al. | 187/288 |
| 5,747,755 | A * | 5/1998 | Coste et al. | 187/394 |
| 6,170,614 | B1 | 1/2001 | Herkel et al. | |
| 6,683,543 | B1 * | 1/2004 | Yeo | 341/13 |

FOREIGN PATENT DOCUMENTS

| | | |
|---|---|---|
| DE | 101 50 284 A1 | 4/2003 |
| EP | 0 477 976 A2 | 4/1992 |
| EP | 0 508 403 A2 | 10/1992 |
| EP | 1 088 782 A1 | 4/2001 |
| EP | 1 278 693 B1 | 1/2003 |
| WO | WO 03/011733 A1 | 2/2003 |

* cited by examiner

*Primary Examiner*—Jonathan Salata
(74) *Attorney, Agent, or Firm*—Klaus P. Stoffel; Wolff & Samson PC

(57) ABSTRACT

A method and system for supervising the safety of an elevator having a car driven by a drive within a hoistway wherein a travel parameter ($X_{ABS}$,$X''_{Acc}$,$X'_{IGB}$) of the car is sensed and continually compared with a similarly sensed travel parameter ($X'_{IG}$) of the drive. If the comparison shows a large deviation between the two parameters, an emergency stop is initiated. Otherwise one of the travel parameters ($X_{ABS}$,$X''_{Acc}$ $X'_{IGB}$; $X'_{IG}$) is output as a verified signal (X;X'). The verified signal is then compared with predetermined permitted values. If it lies outside the permitted range then an emergency stop is initiated.

10 Claims, 4 Drawing Sheets

ELEVATOR SUPERVISION

BACKGROUND OF THE INVENTION

The present invention relates to an elevator supervision method and system which greatly simplify the components used in and the architecture of the safety chain but yet enhance the operating performance of an elevator.

Historically it has been standard practice within the elevator industry to strictly separate the collection of information for safety purposes from that for elevator control purposes. This is partly due to the fact that the elevator controller requires information at high precision and frequency regarding the car's position and speed, whereas the most important factor for the safety chain is that the information supplied to it is guaranteed as fail-safe. Accordingly, while the sensor technology used to supply the controller with information has improved dramatically over recent years, the sensors used in elevator safety chains are still based on relatively old "tried and trusted" mechanical or electromechanical principles with very restricted functionality. The conventional overspeed governor is set to actuate at a single predetermined overspeed value and the collection of safety-relevant positional information is restricted to the hoistway ends and the landing door zones.

Since the controller and the safety chain systems independently gather the same information to a certain extent, there has always been a partial redundancy in the collection of information within existing elevator installations.

There have been proposals to replace components of the safety chain, for example the conventional overspeed governors and the emergency limit switches at the hoistway ends, with more intelligent electronic or programmable sensors. Such a system has been described in WO-A1-03/011733 wherein a single-track of Manchester coding mounted along the entire elevator hoistway is read by sensors mounted on the car and provides the controller with very precise positional information. Furthermore, since it incorporates two identical sensors connected to two mutually supervising processors it fulfils the required parallel redundancy criterion to provide fail-safe safety chain information. However, it will be appreciated that this system is relatively expensive as it necessarily includes a redundant sensor and is therefore more appropriate to high-rise elevator applications than to low and medium-rise installations. Furthermore, since identical sensors are used to measure the same parameter it is inherent that they are more likely to fail at approximately the same time since they are susceptible to the same manufacturing tolerances and operating conditions.

SUMMARY OF THE INVENTION

It is the objective of the present invention to greatly simplify the components used in and the architecture of the safety chain but yet enhance the operating performance of an elevator by using more intelligent systems for the collection of hoistway information. This objective is achieved by providing a method and system for supervising the safety of an elevator having a car driven by driving means wherein a travel parameter of the car is sensed and continually compared with a similarly sensed travel parameter of the driving means. If the comparison shows a large deviation between the two parameters, an emergency stop is initiated. Otherwise one of the travel parameters is output as a verified signal. The verified signal is then compared with predetermined permitted values. If it lies outside the permitted range then an emergency stop is initiated. The travel parameters sensed for the car and the driving means can be one of the following physical quantities; position, speed or acceleration.

Since the verified signal is derived from the comparison of signals from two independent sensor systems, it satisfies current safety regulations.

Furthermore, since the two independent sensor systems monitor different parameters, there is an increased functionality; for example the method and system can easily determine deviations between the operation of the driving means and the travel of the car and initiate a safe reaction if appropriate.

The travel parameter of the car can be sensed by mounting a sensor on the car or, if an existing installation is to be modernized, the travel parameter of the car can be sensed by mounting a sensor on an overspeed governor.

Whereas the conventional overspeed governor has a single predetermined overspeed value, the current invention uses a registry of permitted values so that the overspeed value could be dependent on the position of the car within an elevator shaft for example.

Preferably the deceleration of the car is monitored immediately after every emergency stop. If the deceleration is below a specific value, a safety gear mounted on the car is activated to bring the car to a halt. In the conventional system, the safety gear is only activated at the predetermined overspeed value. So, for example, if the traction rope of an elevator installation were to break, the conventional system would release the safety gear to halt the car only after it has reached the relatively high overspeed limit. Understandably this frictional breaking the car against the guide rail by means of the safety gear at such high speeds can cause serious deterioration of the guide rails and more importantly exert a very uncomfortable impact on any passengers riding in the car.

Other features and advantages of the present invention will become apparent from the following description of the invention that refers to the accompanying drawings.

BRIEF DESCRIPTION OF THE DRAWINGS

The invention is herein described by way of specific examples with reference to the accompanying drawings of which.

DETAILED DESCRIPTION OF THE INVENTION

Figure 1:
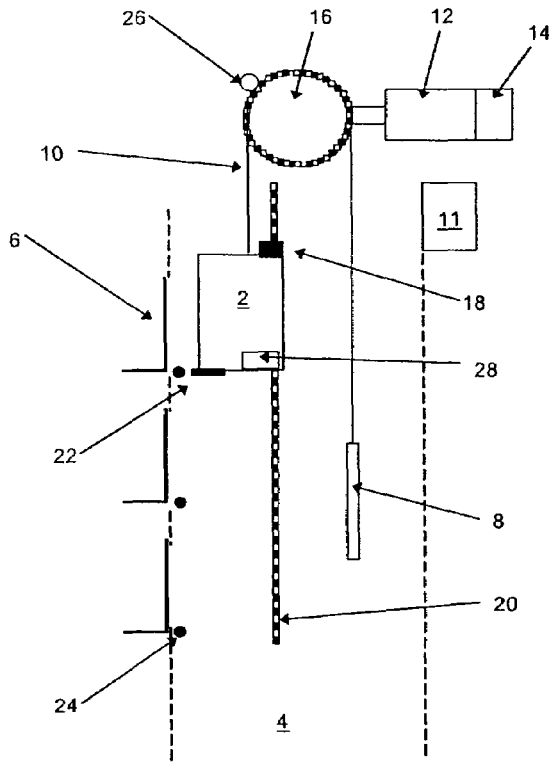
FIG. 1 is a schematic representation of the sensor systems employed in an elevator installation according to a first embodiment of the present invention.

FIG. 1 illustrates an elevator installation according to a first embodiment of the invention. The installation comprises a car 2 movable vertically along guide rails (not shown) arranged within a hoistway 4. The car 2 is interconnected with a counterweight 8 by a rope or belt 10 which is supported and driven by a traction sheave 16 mounted on an output shaft of a motor 12. The motor 12 and thereby the movement of the car 4 is controlled by an elevator controller 11. Passengers are delivered to their desired floors through landing doors 6 installed at regular intervals along the hoistway 4. The traction sheave 16, the motor 12 and the controller 11 can be mounted in a separate machine room located above the hoistway 4 or alternatively within an upper region of the hoistway 4.

As with any conventional installation, the position of the car 4 within the shaft 4 is of vital importance to the controller 11. For that purpose, equipment for producing shaft information is necessary. In the present example such equipment consists of an absolute position encoder 18 mounted on the car 4 which is in continual driving engagement with a toothed belt 20 tensioned over the entire shaft height. Such a system has been previously described in EP-B1-1278693 and further description here is therefore thought to be unnecessary. A magnet 24 is mounted at each landing level of the shaft 4 principally for calibration purposes. On an initial learning run the magnets 24 activate a magnetic detector 22 mounted on the car 4 and thereby the corresponding positions recorded by the absolute position encoder 18 are registered as landing door 6 positions for the installation. As the building settles, the magnets 24 and the magnetic detector 22 are used to readjust these registered positions accordingly. All non-safety-relevant shaft information required by the controller 11 can then be derived directly from the absolute position encoder 18.

A conventional installation would further include an overspeed governor to mechanically actuate safety gear 28 attached to the car 4 if the car 4 travels above a predetermined speed. As is apparent from FIG. 1, this is not included in the present embodiment. Instead, an incremental pulse generator 26 is provided on the traction sheave 26 to continually detect the speed of the traction sheave. Alternatively the incremental pulse generator 26 could be mounted on the shaft of the motor 12. Indeed many motors 12 used in these elevator applications already incorporate an incremental pulse generator 26 to feedback speed and rotor position information to a frequency converter powering the motor 12. The incremental pulse generator 26 provides accurate information on the rotation of the traction sheave 16. A pulse is generated every time the traction sheave 16 moves through a certain angle, and accordingly the frequency of the pulses provides a precise indication of the rotational speed of the traction sheave 12.

The principle behind the present embodiment is to use the incremental pulse generator 26, the absolute position encoder 18 and the magnetic detector 22 (the three independent, single-channel sensor systems) to provide all the required shaft information, not just the non-safety-relevant shaft information.

Figure 2:
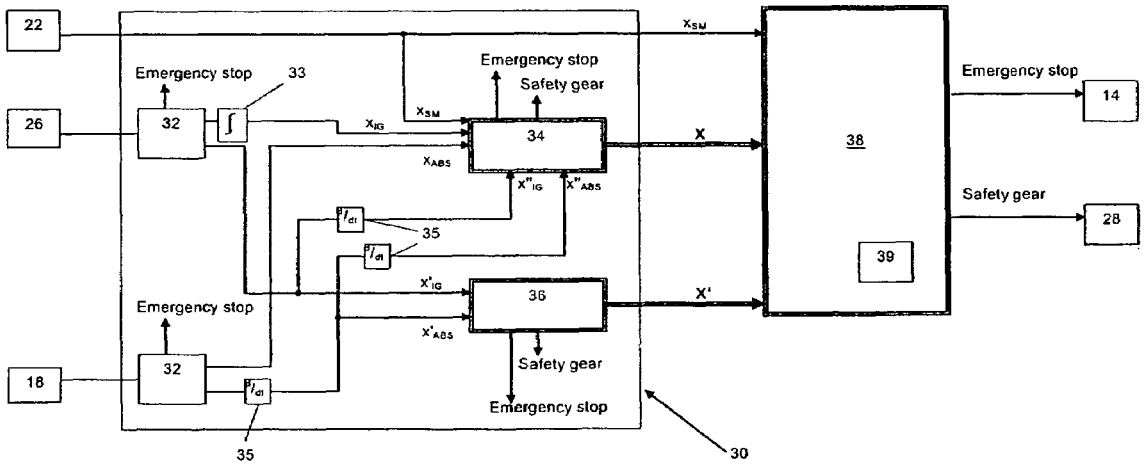
FIG. 2 is a signal flow diagram showing how the signals derived from the sensor systems of FIG. 1 are processed to derive safety-relevant shaft information.

As shown specifically in FIG. 2, the signals derived from the three independent, single-channel sensor systems 18, 22 and 26 are initially supplied to a data verification unit 30. Therein the signals from the incremental pulse generator 26 and the absolute position encoder 18 are submitted to a consistency examination in modules 32 to ensure that they are not erratic. If either of the signals is determined to be erratic, then the corresponding module 32 initiates an emergency stop by de-energizing the motor 12 and actuating a brake 14 connected to the motor 12. The module 32 may also provide an error signal to indicate that the sensor it is examining is faulty.

A position comparator 34 receives as its inputs the positional signal $X_{SM}$ from the magnetic detector 22 and an examined position signal $X_{ABS}$ derived from the absolute position encoder 18. Furthermore, the examined speed signal $X'_{IG}$ derived from the incremental pulse generator 26 is fed through an integrator 33 and the resulting signal $X_{IG}$ is also input to the position comparator 34.

Within the position comparator 34, the position signal $X_{IG}$ derived from the incremental pulse generator 26 and the position signal $X_{ABS}$ from the absolute position encoder 18 are calibrated against the positional signal $X_{SM}$ from the magnetic detector 22. The main difference between the incremental pulse generator 26 and the absolute position encoder 18 is that whereas the incremental pulse generator 26 produces a standard pulse on every increment, the absolute position encoder 18 produces a specific, unique bit pattern for every angle increment. This "absolute" value does not require a reference procedure as with the incremental pulse generator 26. Hence, although the shaft magnets 24 and the magnetic detector 22 are used to readjust the registered landing door 6 positions as recorded by the absolute position encoder 18, once the building has settled it will be understood that the absolute position encoder 18 knows all door positions with a high degree of accurately and no further calibration with the magnetic detector 22 is therefore required. The incremental pulse generator 26 on the other hand requires continual calibration with the magnetic detector 22 because the magnetic detector 22 indicates car position whereas the signal from incremental pulse generator 26 is used to indicate traction sheave position and any slippage of the rope or band 10 in the traction sheave 16 will automatically throw the incremental pulse generator 26 out of calibration with the actual car position. This calibration is carried out in the position comparator 34 each time the magnetic detector 22 on the car 4 senses a shaft magnet 24.

Other than the calibration processes outlined above, the main purpose of the position comparator 34 is to continually compare the position signal $X_{IG}$ derived from the incremental pulse generator 26 with the corresponding position signal $X_{ABS}$ from the absolute position encoder 18. If the two signals differ by for example one percent or more of the entire shaft height HQ, then an emergency stop is initiated by de-energizing the motor 12 and actuating the brake 14. In some rare instances, for example if the rope 10 has broken, this emergency stop will not be sufficient to stop the car 4. In such situations the position comparator 34 monitors acceleration signals $X''_{IG}$ and $X''_{ABS}$ derived by feeding the signals from the incremental pulse generator 26 and the absolute position encoder 18 through differentiators 35 to ensure that the car 2 decelerates by at least 0.7 $m/s^2$. If not, the position comparator 34 electrically triggers the release of the safety gear 28 (shown in FIG. 1) mounted on the car 2 so that it frictionally engages with the guide rails and thereby brings the car 4 to a halt. The electrical release of an elevator safety gear is well known in the art as exemplified in EP-B1-0508403 and EP-B1-1088782.

Otherwise the condition represented in the equation below is satisfied and the signal $X_{ABS}$ from the absolute position encoder 18 having been verified against an independent sensor signal $X_{IG}$ can be used as a safety-relevant position signal $$\frac{X_{ABS} - X_{IG}}{HQ} < 1\%$$

Although the following description details specifically how the safety-relevant position signal X is used to supervise the safety of the elevator, it will be appreciated that the signal X can be, and is, used additionally to provide the controller 11 with the required hoistway information.

The data verification unit 30 also includes a speed comparator 36 wherein the examined speed signal $X'_{IG}$ derived from the incremental pulse generator 26 is taken as an input. The examined signal from the absolute position encoder 18 is fed through a differentiator 35 to provide a further input $X'_{ABS}$ representing speed. The two speed values $X'_{IG}$ and $X'_{ABS}$ are continually compared with each other in the speed comparator 36 and should they deviate by more than five percent an emergency stop is initiated by de-energizing the motor 12 and actuating the brake 14. At approximately two seconds after initiating the emergency stop, the speed comparator 36 releases the safety gear 28.

Otherwise the conditions represented in both of the equations below are satisfied and the signal $X'_{ABS}$ derived from the absolute position encoder 18 having been verified against an independent sensor signal $X'_{IG}$ can be used as a safety-relevant speed signal X'.

$$\frac{X'_{ABS} - X'_{IG}}{X'_{ABS}} < 5\% \text{ AND } \frac{X'_{IG} - X'_{ABS}}{X'_{IG}} < 5\%$$

As with the safety-relevant position signal X, the safety-relevant speed signal X' can be fed to the controller 11 to provide the required hoistway information as well as being used to supervise the safety of the elevator.

The signal $X_{SM}$ from the magnetic detector 22 is fed into a safety supervisory unit 38 together with the safety-relevant position signal X from the position comparator 34 and the safety-relevant speed signal X' from the speed comparator 34. These safety-relevant signals X and X' are continually compared with nominal values stored in position and overspeed registries 39. If, for example, the safety-relevant speed signal X' exceeds the nominal overspeed value, the safety supervisory unit 38 can initiate an appropriate reaction. Additionally, the safety supervisory unit 38 is supplied with conventional information from door contacts monitoring the condition of the landing doors 6 and from the car door controller or car door contacts. If an unsafe condition occurs during operation of the elevator the safety supervisory unit 38 can initiate an emergency stop by de-energizing the motor 12 and actuating the brake 14 and, if necessary, releasing the safety gear 28 to bring the car 4 to a halt.

During installation, the elevator car 4 is sent on a learning journey during which the technician moves the car 4 at a very low speed (e.g. 0.3 m/s). As the car 4 moves past the landing doors 6, the associated shaft magnets 24 are detected by the car mounted magnetic sensor 22 and the safety supervisory unit 38 acknowledges each of these positions by registering the corresponding verified position signal X derived from the absolute position encoder 18 into the appropriate registry 38. Furthermore, a zone of ±20 cm from each magnet 24 is registered as the door opening zone in which the doors 6 can safely commence opening during normal operating conditions of the elevator installation. The uppermost and lowermost magnets 24 mark the extremes in the car travel path and from these the overall travel distance or shaft height HQ can be calculated. The maximum permissible speed curves (maximum nominal speed depending on the position of the car 2) can then be defined and recorded into the appropriate registry 38.

As mentioned previously, the continual comparison of signals derived from the three sensor systems within the data verification unit 30 as well as the consistency examination of the signals from the incremental pulse generator 26 and the absolute position encoder 18 ensure that a fault with any of the sensor systems can be identified quickly and an emergency stop initiated. Furthermore, if the data verification unit 30 detects a significant amount of rope slippage by means of the comparators 34 and 36, it immediately initiates an emergency stop. If the emergency stop fails to retard the car 2 sufficiently, the position comparator releases the safety gear 28.

The safety supervisory unit 38 detects faults in the operation of the controller 11. If the controller permits the car 2 to travel at too great a speed, a comparison within the safety supervisory unit 38 of the safety-relevant speed signal X' from the data verification unit 30 with the overspeed registry 39 will identify the fault and the safety supervisory unit 38 can initiate an emergency stop.

Figure 3:
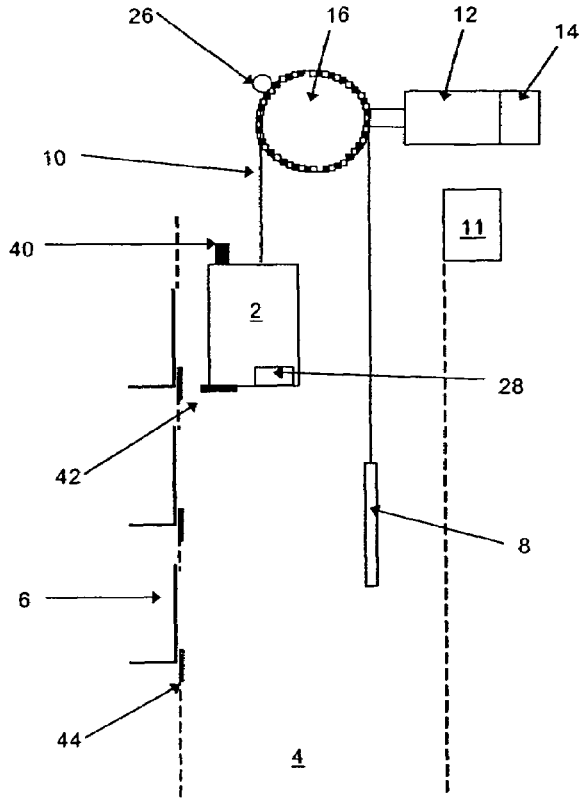
FIG. 3 is a schematic representation of the sensor systems employed in an elevator installation according to a second embodiment of the present invention.
Figure 4:
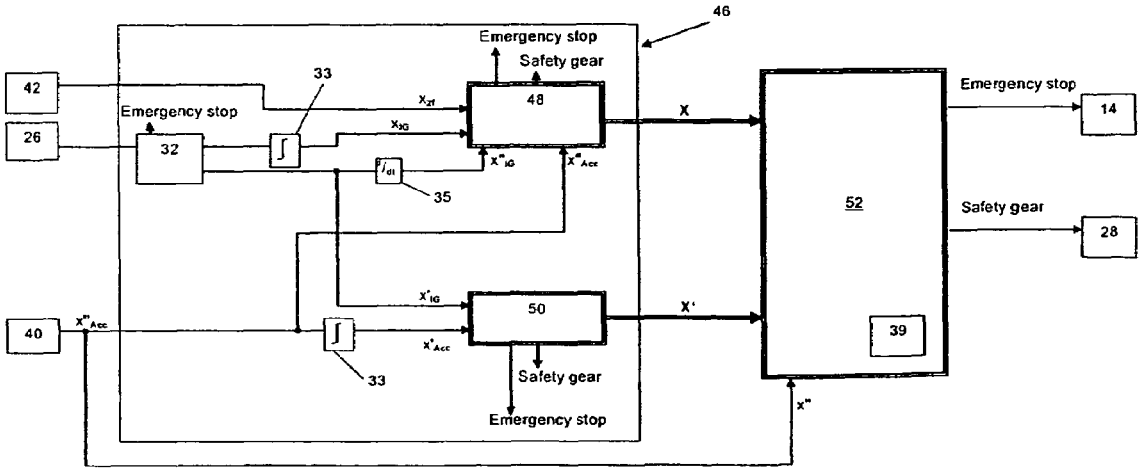
FIG. 4 is a signal flow diagram showing how the signals derived from the sensor systems of FIG. 3 are processed to derive safety-relevant shaft information.

FIGS. 3 and 4 show a second embodiment of the present invention in which the shaft magnets 24 and magnetic detector 22 of the previous embodiment have been replaced with conventional zonal flags 44 symmetrically arranged 120 mm above and below each landing floor level together with an optical reader 42 mounted on the car 2 to detect the flags 44. Additionally, the absolute position encoder 18 has been replaced by an accelerometer 40 mounted on the car 4.

Within the data verification unit 46 of the present embodiment, the signal $X_{IG}$ derived from the incremental pulse generator 26 is compared with and calibrated against the position signal $X_{ZF}$ from the optical reader 42. The distance $\Delta X_{ZF}$ between successive flags 44 is recorded and compared to the corresponding distance $\Delta X_{IG}$ derived from the incremental pulse generator 26. If this comparison gives rise to a deviation in the two distances of two percent or more then an emergency stop is initiated by de-energizing the motor 12 and actuating the brake 14. Furthermore, the deceleration of system is monitored after the emergency stop has been initiated to ensure that (at least one of) the signals derived from both the incremental pulse generator 26 and the accelerometer 18 show a deceleration of at least 0.7 m/s$^2$, indicating that the emergency stop is sufficient to bring the car 2 to a halt. If not, safety gear 28 (shown in FIG. 1) mounted on the car 2 is released to frictionally engage with the guide rails and thereby bring the car 4 to a halt.

Otherwise the condition represented in the equation below is satisfied and the signal $X_{IG}$ derived from the incremental pulse generator 26 having been verified against an independent sensor signal $X_{ZF}$ can be used as a safety-relevant position signal X.

$$\frac{\Delta X_{ZF} - \Delta X_{IG}}{\Delta X_{ZF}} < 2\%$$

The data verification unit 46 also includes a speed comparator 50 wherein the examined speed signal $X'_{IG}$ derived from the incremental pulse generator 26 is taken as an input. The signal $X''_{Acc}$ from the accelerometer 40 is fed through an integrator 33 to provide a further input $X'_{Acc}$ representing the vertical speed of the car 2. The two speed values $X'_{IG}$ and $X'_{Acc}$ are continually compared with each other in the speed comparator 50 and should they deviate by more than five percent an emergency stop is initiated by de-energizing the motor 12 and actuating a brake 14. As in the previous embodiment, At approximately two seconds after initiating the emergency stop, the speed comparator 36 releases the safety gear 28.

Otherwise the conditions represented in both of the equations below are satisfied and the signal $X'_{IG}$ derived from the incremental pulse generator 26 having been verified against an independent sensor signal $X'_{Acc}$ can be used as a safety-relevant speed signal X'.

$$\frac{X'_{Acc} - X'_{IG}}{X'_{Acc}} < 5\% \text{ AND } \frac{X'_{IG} - X'_{Acc}}{X'_{IG}} < 5\%$$

The acceleration signal $X''_{Acc}$ from the accelerometer 40 is fed into a safety supervisory unit 52 together with the safety-relevant position signal X from the position comparator 48 and the safety-relevant speed signal X' from the speed comparator 50. If an unsafe condition occurs during operation of the elevator the safety supervisory unit 38 can initiate an emergency stop by de-energizing the motor 12 and actuating the brake 14 and, if necessary, activate the safety gear 28 to bring the car 4 to a halt.

Figure 5:
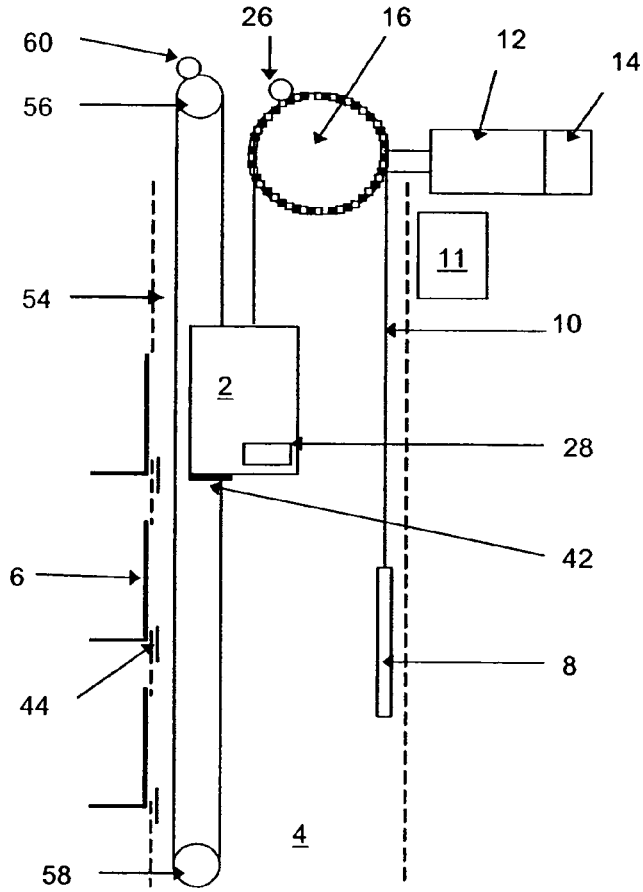
FIG. 5 is a schematic representation of the sensor systems employed in an elevator installation according to a further embodiment of the present invention.
Figure 6:
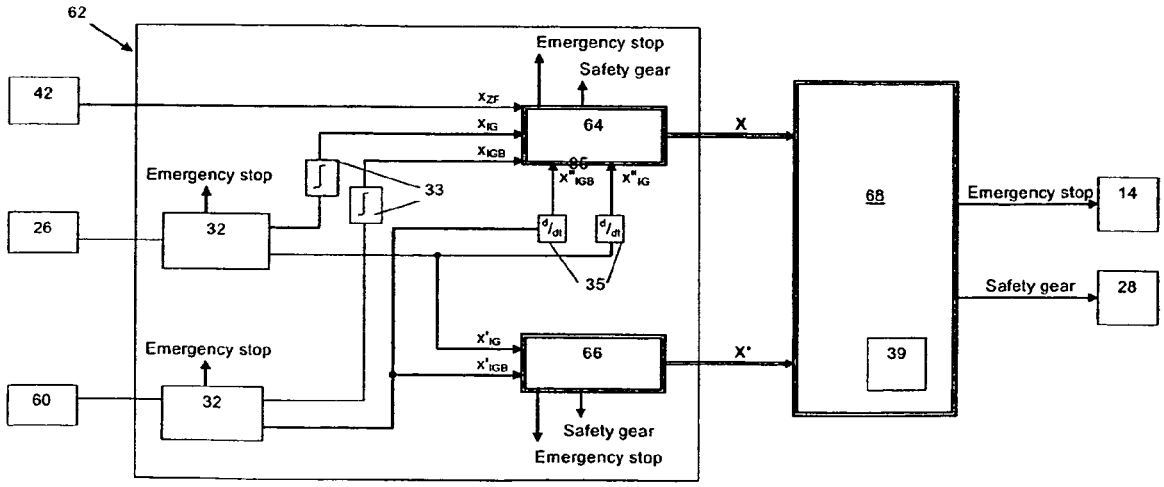
FIG. 6 is a signal flow diagram showing how the signals derived from the sensor systems of FIG. 5 are processed to derive safety-relevant shaft information.

FIGS. 5 and 6 show an existing elevator installation which has been modified in accordance with yet a further embodiment of the present invention. The existing installation includes a conventional overspeed governor which is an established and reliable means of sensing the speed of the elevator car 2. The governor has a governor rope or cable 54 connected to the car 2 and deflected by means of an upper pulley 56 and a lower pulley 58. In the conventional system, the upper pulley 56 would house the centrifugal switches set to activate at a predetermined overspeed value for the car 2. In the present embodiment these switches are replaced by an incremental pulse generator 60 mounted on the upper pulley 56.

The processing of the information received from the pulley incremental pulse generator 60, the traction sheave incremental pulse generator 26 and the optical reader 42 is the same as in the previous embodiments in that the signals are verified and compared in a data verification unit 62 to supply a safety-relevant position signal X and a safety-relevant speed signal X' to a safety supervisory unit 68.

Figure 7:
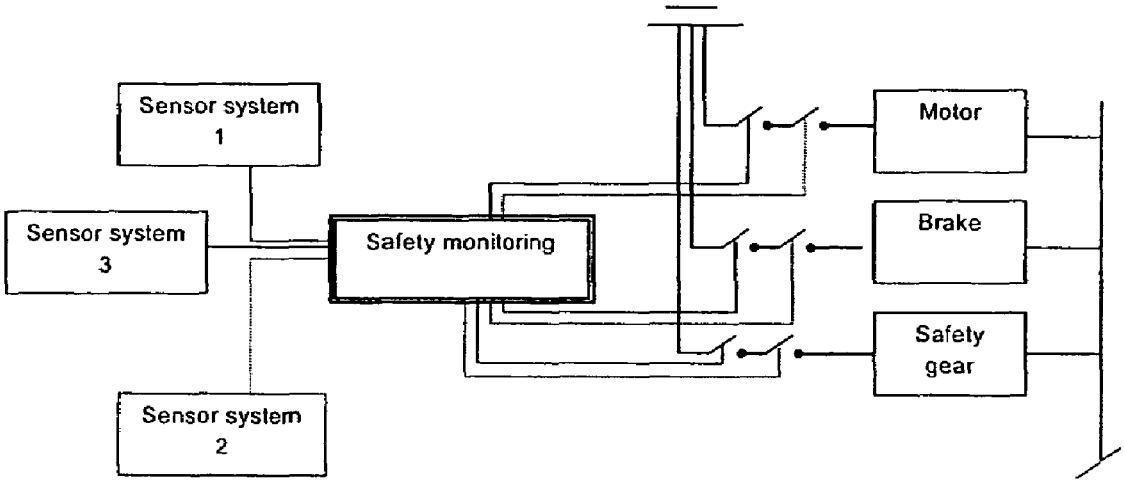
FIG. 7 is an overview of the general system architecture of the embodiments of FIGS. 1 to 6.

FIG. 7 is an overview of the system architecture of the previously described embodiments. Three independent single-channel sensor systems are connected to a safety monitoring unit which in the embodiments hitherto described comprises a data verification unit and a safety supervision unit. The safety monitoring unit derives safety-relevant positional and speed information which it uses to bring the elevator into a safe condition by de-energizing the motor, activating the brake and/or activating the safety gear.

The brake need not be mounted on the motor, but could form a partial member of the safety gear. If the safety gear consists of four modules, then normal braking could for example be instigated by actuating two of the four modules.

In all of the described embodiments of the invention it will be understood that the signals derived from the data verification units and the safety supervision units can be used to provide the necessary shaft information for the elevator controller 11 as well as performing the safety-relevant objectives for the elevator.

Furthermore, it will be appreciated that the invention is equally applicable to hydraulic elevator installations as to traction installations.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for supervising the safety of an elevator having a car driven by driving means, comprising the steps of:

a) sensing a travel parameter of the car;

b) sensing a travel parameter of the driving means;

c) comparing the travel parameters such that if there is a deviation between the two parameters of more than a given value an emergency stop is initiated, otherwise outputting one of the travel parameters as a verified signal;

d) comparing the verified signal with predetermined permitted values; and e) initiating an emergency stop if the verified signal is outside the permitted values.

2. A method according to claim 1, wherein between steps b) and c) there is a further step of converting one or both of the sensed travel parameters so that they both refer to a first physical quantity.

3. A method according to claim 2, wherein steps a) to e) are simultaneously executed for a second physical quantity.

4. A method according to claim 1, further comprising the step of monitoring deceleration of the car after an initiation of an emergency stop and activating a safety gear if the deceleration is below a specific value.

5. A method according to claim 1, wherein the sensed travel parameter of the car or the driving means is one of position, speed or acceleration.

6. A safety supervision system for an elevator installation having a car driven by driving means, the system comprising:

a first sensor for indicating a travel parameter of the car;

at least one registry containing permitted travel parameter values;

a second sensor for indicating a travel parameter of the driving means;

first comparator means for comparing the parameters to produce an emergency stop if the two parameters deviate by more than a given value, otherwise outputting one of the sensed travel parameters as a verified signal; and second comparator means for comparing the verified signal with the permitted travel parameter values in the registry and initiating an emergency stop if the verified signal lies outside the permitted values.

7. A system according to claim 6, and further comprising converter means for converting at least one of the sensed travel parameters so that they both refer to a first physical quantity.

8. A system according to claim 6, and further comprising a deceleration monitor to activate a safety gear mounted on the car if the deceleration after an initiation of an emergency stop is below a specific value.

9. A system according to claim 6, wherein the first sensor is mounted on the car.

10. A system according to claim 6, wherein the first sensor is mounted on an overspeed governor connected to the car.

* * * * *